United States Patent [19]

Schrepfer

[11] Patent Number: 4,911,248

[45] Date of Patent: Mar. 27, 1990

[54] EARTH COMPACTING APPARATUS AND METHOD

[75] Inventor: Martin P. Schrepfer, Lakeside, Calif.

[73] Assignee: P.S. Construction, Santee, Calif.

[21] Appl. No.: 217,168

[22] Filed: Jul. 11, 1988

[51] Int. Cl.[4] ..... A01B 63/102; E01C 19/26

[52] U.S. Cl. ..... 172/464; 172/471; 172/470; 404/122

[58] Field of Search ..... 172/464, 474, 484, 491, 172/471, 470, 438, 248–253, 463, 468, 136, 228, 230, 260.5, 699, 40; 404/117, 83, 103, 84, 128, 130, 132, 123; 173/49, 22, 94; 37/117.5

[56] References Cited

U.S. PATENT DOCUMENTS

| | | | |
|---|---|---|---|
| 2,672,994 | 3/1954 | Werner et al. | 404/128 |
| 3,433,310 | 3/1969 | Harper | 172/471 |
| 3,552,497 | 1/1971 | Stedman | 172/484 |
| 3,891,342 | 6/1975 | Roe | 404/128 |
| 3,993,413 | 11/1976 | Cox et al. | 404/128 |
| 4,023,288 | 5/1977 | Roe | 37/117.5 |
| 4,204,578 | 5/1980 | Stedman | 172/484 |
| 4,224,003 | 9/1980 | St. Louis | 404/133 |
| 4,269,535 | 5/1981 | Schultz | 404/117 |
| 4,289,422 | 9/1981 | De Klerk et al. | 404/124 |
| 4,420,189 | 12/1983 | Von Ruden | 299/40 |
| 4,436,477 | 3/1984 | Lenertz et al. | 414/723 |
| 4,487,268 | 12/1984 | Greve | 172/491 |
| 4,610,567 | 9/1986 | Hosking | 404/123 |
| 4,648,466 | 3/1987 | Baker | 172/260.5 |

*Primary Examiner*—Richard J. Johnson

*Attorney, Agent, or Firm*—Brown, Martin, Haller & McClain

[57] ABSTRACT

An earth compacting apparatus for mounting at one end of an earth working vehicle comprises a plurality of separate compaction units and a pivotal linkage for pivotally mounting the compaction units side by side on a vehicle. An actuator assembly operates on the linkage for independently raising and lowering each compaction unit between a raised, inoperative position and a lowered position in contact with the ground. The actuator assembly also provides downward pressure on each compaction unit in the lowered position.

13 Claims, 4 Drawing Sheets

EARTH COMPACTING APPARATUS AND METHOD

BACKGROUND OF THE INVENTION

The present invention relates generally to ground working equipment and vehicles used in construction, and more particularly to earth compacting apparatus and other tools attached to such vehicles for performing various ground working tasks, such as compacting loose fill dirt in trenches on construction sites, or in road construction or repair.

When constructing buildings, roads, and other developments, it is necessary to dig trenches for underground pipelines and the like. When the dirt is refilled, the dirt must be closely packed to prevent or reduce the risk of later settling and possible damage as a result of foundation cracking. It is also necessary to compact dirt during road repair or construction, since substantial damage may result from settling earth under roadways. The asphalt surface of roads must also be compacted or smoothed by suitable rollers.

One technique used in the past for compacting earth in trenches has been first to push fill dirt into the trench using a tractor with a blade, subsequently compacting the earth with vibratory devices. This is a slow and labor-intensive process. Compaction wheels are known which can be mounted on a tractor or other earth working vehicle which is then driven over the ground to be compacted. In U.S. Pat. No. 4,023,288 of Roe, for example, a compaction roller is attached to a backhoe or similar boom device mounted on a tractor. An integral scraper blade is provided for scraping fill dirt into a trench for subsequent compaction. This allows a trench to be compacted much faster than with vibratory devices, since a single vehicle is used both to fill in and to compact the dirt. The compaction roller is in the form of a cylindrical drum with teeth projecting radially outwardly from its surface.

U.S. Pat. No. 4,269,535 of Schultz shows a bulldozer having a blade at its forward end and an earth compactor at its rear end. The earth compactor comprises three sets of rotatably mounted sheep's foot compaction wheels on a common axle which can be raised and lowered by an hydraulic actuator to place the wheels in contact with the ground surface and to apply down pressure on the wheels.

In both of these devices, the compaction width of the assembly is fixed so that more than one pass of the vehicle may be necessary for some trench widths.

SUMMARY OF THE INVENTION

It is the object of the present invention to provide an improved ground working apparatus for attachment to a suitable vehicle.

According to the present invention, a compaction apparatus for mounting on a ground or earth working vehicle is provided, the apparatus comprising at least two, separate compaction units, a pivot linkage for pivotally mounting the compaction units side by side on the ground working vehicle, and an actuator assembly for independently raising and lowering each compaction unit between a raised position spaced above the ground and a lowered position contacting the ground, and for applying down pressure on each compaction unit in the lowered position.

The compaction units are preferably releasably mounted on the linkage. Any suitable compaction unit may be mounted on the vehicle in this way, such as compaction rollers, vibratory plates or drums. Other types of earth working tool may also be used on the apparatus, and combinations of different tool units may be mounted side by side so that the same vehicle can be used for various tasks. In one example, each compaction unit comprises a compaction roller rotatably mounted on an axle, each axle being pivotally linked via a first linkage to a common mounting bar, the mounting bar being pivotally linked via a second pivot linkage to extend across a vehicle.

The actuator assembly preferably comprises a first set of hydraulic actuators for selectively raising and lowering each compaction unit relative to the mounting bar, and a second hydraulic actuator for selectively raising and lowering the mounting bar so as to apply down pressure on any lowered compaction unit.

With this apparatus, the operator can selectively lower only one of the compaction units for a narrow ditch, or more than one of the units for wider ditches. In the preferred arrangement, a row of three independently operable compaction units is provided. Where three compaction devices are provided, a range of compaction area widths from around one foot to the width of the machine can be provided in one pass. The wheel or compaction device widths can be arranged to conform to most or all standard trench sizes, so that in most cases a trench can be compacted in one pass of a vehicle.

Preferably, a mechanical interlock is provided between the mounting bar and each compaction unit mounting assembly when that unit is in the lowered position. This interlock takes the back load when downward pressure is applied to the compaction unit, since the hydraulic actuator system typically will not be able to take back loads in excess of 5,000 to 10,000 lbs, and hydraulic lines may fail under such loads. The mechanical interlock ensures that back load is applied to the vehicle via the mounting bar and linkage, rather than to the hydraulic assembly.

In the preferred embodiment of the invention, the apparatus is designed to be releasably mounted on an earth moving machine in place of the ripper bar which is conventionally mounted on such a vehicle. Thus, the apparatus is designed to attach at the same mounting points as the ripper bar assembly, and can easily be removed and replaced as necessary.

The apparatus of this invention is very versatile, allowing several identical or identical or different tool units to be mounted on a single earth working vehicle. When compaction devices are used, the apparatus allows fill dirt in various width ditches to be compacted easily and efficiently, normally in only one pass of the earth working machine on which the apparatus is mounted.

According to another aspect of the present invention, a method of compacting excavations is provided, using a plurality of compaction devices mounted side by side on a suitable vehicle.

The method comprises the steps of lowering a selected number of compaction units into an operative position in contact with the ground, the selected number of units corresponding in width to the width of trench to be compacted in one pass, and compacting fill material in the trench by applying a substantial amount of down pressure on the lowered compaction units while driving the vehicle over the material to be compacted.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
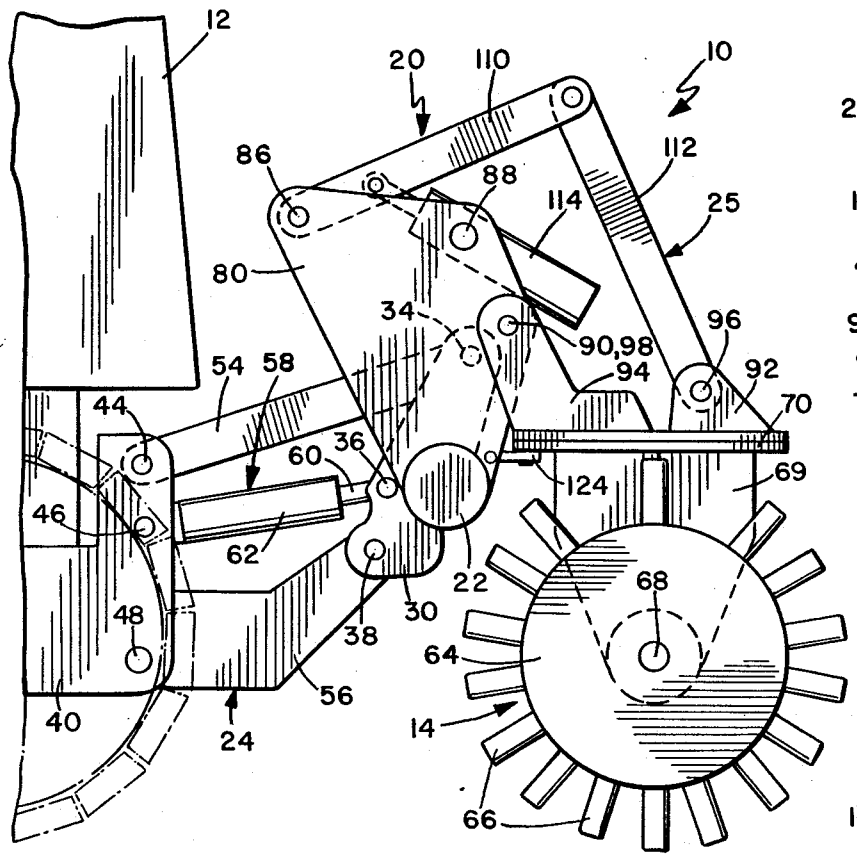
FIG. 1 is a side elevation view of the compaction apparatus according to a preferred embodiment of the present invention, the apparatus being shown attached to the rear end of a track loader.

The drawings illustrate a preferred embodiment of the ground working or compacting apparatus 10 of this invention. The apparatus is designed to be secured on an earth working vehicle, such as a track loader 12 as shown in FIG. 1. It will be understood that the apparatus may alternatively be mounted on any suitable earth or road working vehicle, such as a wheeled loader, dozer, road grader, or the like. The apparatus is shown mounted at one end of the vehicle in FIG. 10. However, it may be mounted at any suitable location where earth working tools are conventionally located, such as the front or rear end, or beneath the vehicle.

The apparatus 10 shown in the drawings comprises three separate compaction units 14, 16 and 18 mounted side by side across the vehicle by means of pivotal mounting assembly 20. In the drawings, the compaction units each comprise a compaction wheel. However, other compaction devices such as vibratory plates or drum rollers may be used. Also, other construction or earth working tools such as hydro-hammers, ripper shanks or blades, and the like may be used in place of the compaction units if desired.

The mounting assembly 20 is preferably designed to be secured at one end of the vehicle or underneath the vehicle at the same attachment points as a standard ripper bar which would normally be mounted on such a vehicle. Thus, the mounting assembly includes a mounting bar 22 which replaces a standard ripper bar, the mounting bar being pivotally mounted across the rear end of the vehicle by a multi-part pivotal linkage 24 which may be identical to the linkage used for mounting a conventional ripper bar. The compaction wheel units 14, 16, and 18 are independently mounted on the mounting bar 22 by three separate sets 25, 26, and 28, respectively, of pivotally linked arms.

The mounting bar 22 has two spaced pairs of rearwardly facing yoke plates 30, 32 secured at spaced intervals, each pair having three spaced attachment points 34, 36, and 38 for pivotal connection to the pivotal linkage 24. Two spaced mounting plates 40 at the rear end of the vehicle (only one of which is visible in the drawings) each have three corresponding attachment points 44, 46 and 48. The pivotal linkage is preferably the same as is used to connect a standard ripper bar to the vehicle, and includes two sets of linkage arms extending between each mounting plate and the corresponding pair of yoke plates. The two sets each comprise a first arm 54 pivotally connected at opposite ends to the uppermost attachment points 34 and 44, respectively, and a second arm 56 pivotally connected at opposite ends to the lower attachment points 38 and 48. The second arms 56 of each set are secured together via a connecting plate (not shown). A hydraulic actuator 58 comprising piston 60 and cylinder 62 is connected between each yoke plate pair and the corresponding mounting plate, each piston being pivotally connected at point 36 of the respective yoke plates and the cylinder being pivotally connected at point 46 of the aligned mounting plate. Thus extension of piston 60 out of cylinder 62 will act on the trapezoidal linkage 54, 30, and 56 to increase the angle between members 54 and 30, lowering the bar 22 towards the ground.

In practice the compacting apparatus will be mounted on the vehicle utilizing the existing pivot linkage 24 on which a conventional ripper bar was mounted, simply by releasing the ripper bar at points 34, 36 and 38 and pivotally securing the compaction wheel mounting bar to the existing pivot linkage 24 at the equivalent points. However, the apparatus may alternatively include its own pivot linkage for securing at any suitable location on any earth working vehicle of sufficient strength.

Figure 2:
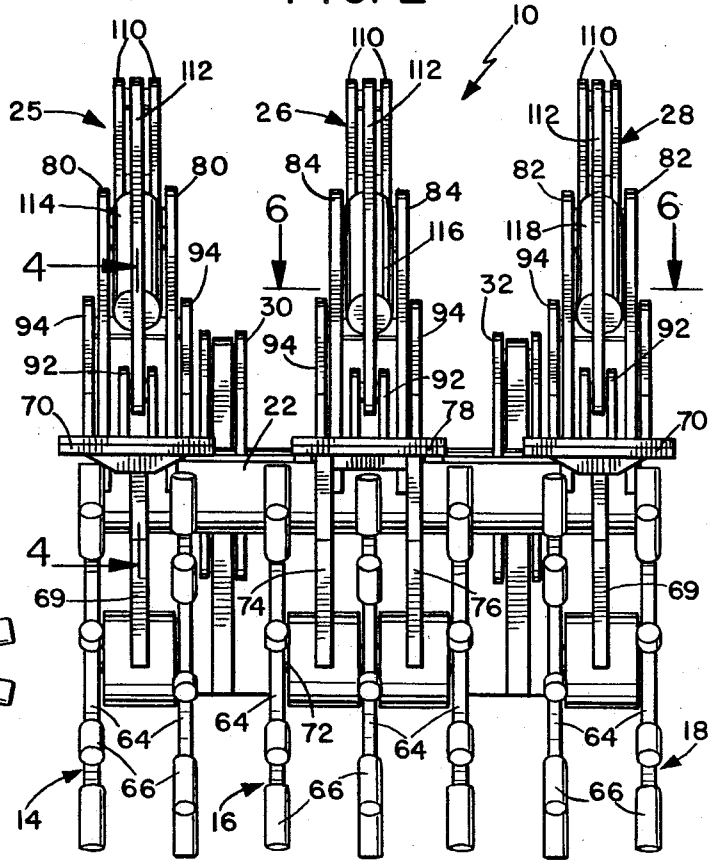
FIG. 2 is a rear end view of the apparatus, the structure of the supporting vehicle being omitted for clarity.

As best shown in FIGS. 1 and 2, the outer compaction wheel units 14 and 18 are identical, and like reference numerals are used for equivalent parts as appropriate. Each unit 14 and 18 in the embodiment shown comprises a pair of compaction wheels or discs 64 each having a plurality of spokes or teeth 66 of the sheep's foot type projecting radially from their outer periphery. The wheels of each unit are rotatably mounted on an axle 68 which is secured via yoke 69 to a transverse wheel or tool mounting plate 70. The central wheel unit 16 is similar to the outer units but is wider, having three spaced compaction discs 64 mounted on an axle 72 which is secured by a pair of yokes 74 and 76 to transverse wheel or tool mounting plate 78 which is identical to the outer wheel mounting plate 70. It will be understood that the compaction wheel units may be replaced with other types of compaction devices if desired, such as drum rollers or vibratory devices.

The tool mounting plates 70 and 78 are preferably each formed as two separate plates which are bolted together in face to face engagement as indicated in the drawings, to allow for easy removal of the individual wheel units for replacement by alternative compaction devices or tools, or for maintenance. Thus, one or more of the units 14, 16 and 18 may be removed and replaced with other compaction devices such as vibratory plates or drum rollers, or even by other earth working tools, such as hydro-hammers, ripper shanks or blades, and the like, by releasably securing the selected tool unit to the appropriate tool mounting plate. The vehicle can then carry more than one type of tool simultaneously, with the operator deploying the appropriate tool as necessary. The plates 70 and 78 may alternatively each comprise a single plate member, from which a suitable compaction device depends.

Figure 6:
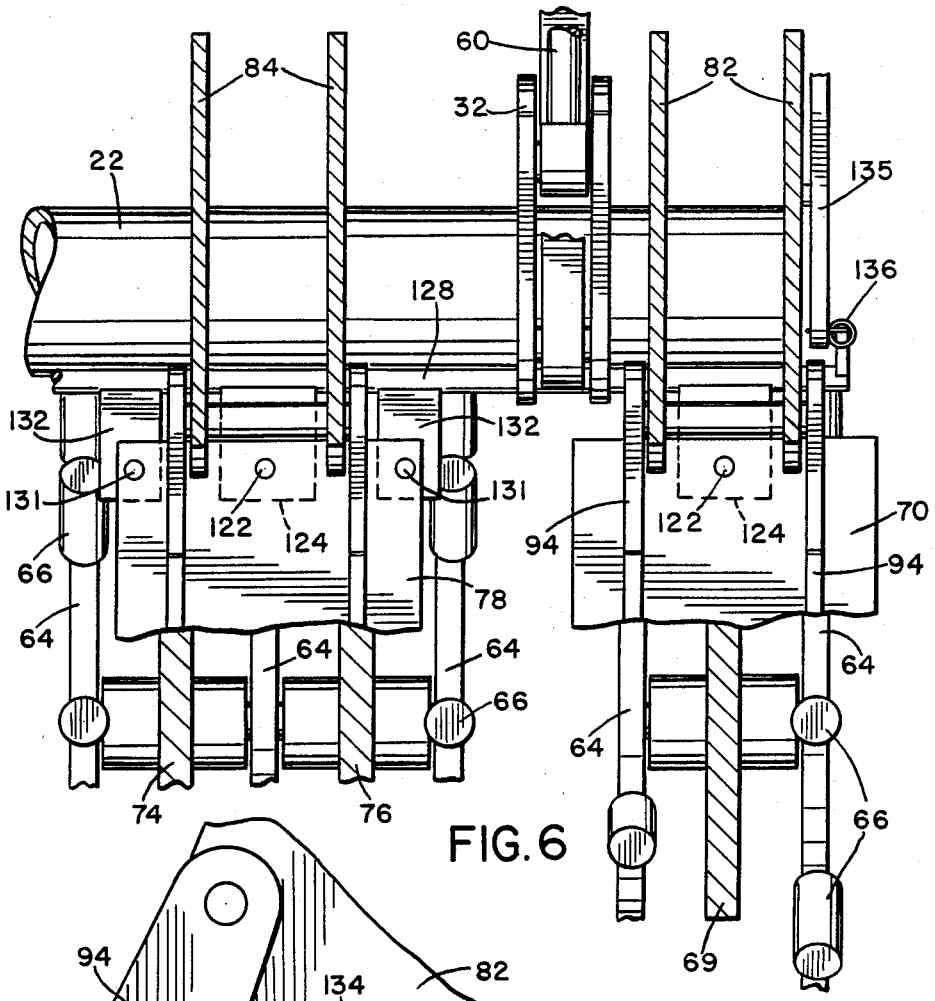
FIG. 6 is an enlarged sectional view taken on the line 6—6 of FIG. 2.

Each plate is pivotally linked to the mounting bar 22 at spaced intervals by the linkages 25, 26 and 28 respectively, the outer compaction units being secured at the outer ends of the bar and the central unit being secured to the central area of the bar. The linkages between each compaction unit and the mounting bar are identical, and equivalent reference intervals are used for like parts where appropriate. As best shown in FIGS. 1, 2 and 6, three spaced pairs of compaction unit support plates 80, 82 and 84 are secured at opposite ends and the center of the mounting bar, respectively, the orientation of the mounting plates 80, 82 and 84 relative to the vehicle mounting plates 30 and 32 being arranged in accordance with the desired range of movement of the compaction units, as explained in more detail below.

Each pair of mounting plates has three spaced hinge or pivot mounting points 86, 88 and 90. Each compaction unit mounting plate 70 and 78 has a pair of upwardly projecting ears 92 and 94 at its front and rear ends providing two spaced hinge mounting points 96 and 98. The sets of linkage arms 25, 26 and 28 extend between the compaction unit support plates on the mounting bar and the compaction unit mounting plates 70 and 78, and are pivotally secured between respective spaced mounting points on those plates by means of suitable pivot or hinge pins. The linkage arms each comprise a pair of pivotally connected bars 110 and 112, each bar 110 being hinged at its free end to pivot point 86 on the respective support plates 80, 82, 84, and bar 112 being hinged at its free end to the forward mounting point 96 of the equivalent compaction unit mounting plate 70 or 78, respectively. As seen in FIG. 2, bar 110 actually comprises a pair of spaced parallel members for added strength. Rear mounting point 98 is directly linked via a suitable hinge pin to the lowermost mounting point 90 of the respective support plate.

A hydraulic actuator 114, 116 and 118 extends between the bar 110 of each set of linkage arms and the central mounting point 88 of the corresponding pair of wheel support plates on the mounting bar 22. Each actuator comprises a piston 115 and cylinder 117. This allows each compaction unit to be raised and lowered independently by operating the respective actuator 114, 116 and 118 as explained in more detail below. Extension of the piston 115 of any actuator will rotate the corresponding compaction unit about connecting point 90 in an anti-clockwise direction, raising the unit, while retraction of the piston will lower the unit.

Figure 4:
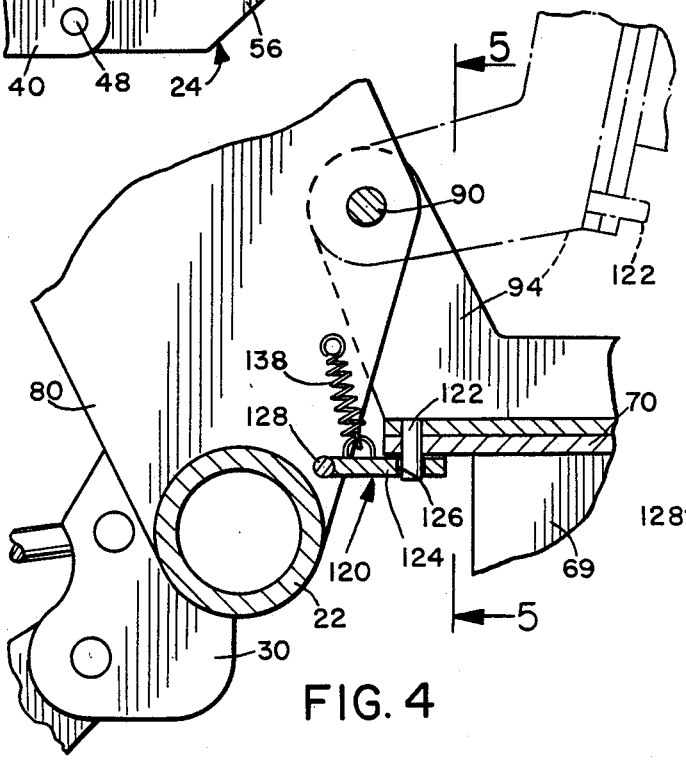
FIG. 4 is an enlarged sectional view taken on the line 4—4 of FIG. 2.
Figure 5:
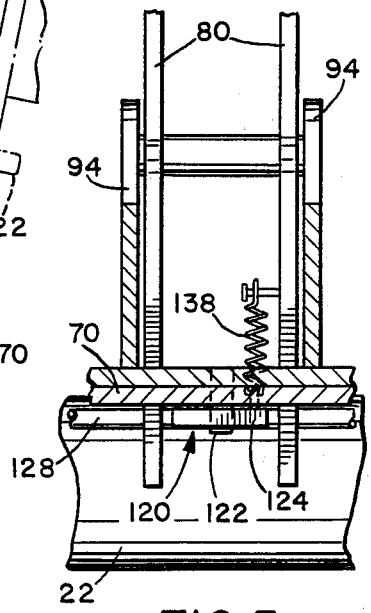
FIG. 5 is a sectional view taken on the line 5—5 of FIG. 4.

A mechanical linkage 120 is provided between the mounting bar and each compaction unit in the lowered position shown in FIG. 4. The linkage comprises a pin 122 projecting downwardly from each mounting plate 70 and 78 and a retainer plate 124 projecting forwardly from each respective support plate 80, 82 and 84 of the mounting bar. Plate 124 has a slot 126 through which pin 122 projects in the lowered position shown in FIGS. 4 and 5. The three retainer plates are all mounted on a common mounting pin 128 which extends through aligned mounting slots 130 in each of the support plates 80, 82 and 84. The central compaction unit linkage 120 preferably has two additional pins 131, one on each side of pin 122, which engage corresponding plates 132 secured to mounting pin 128 as seen in FIG. 6. The additional pin and plate linkages allow for the additional weight of the center unit.

Figure 7:
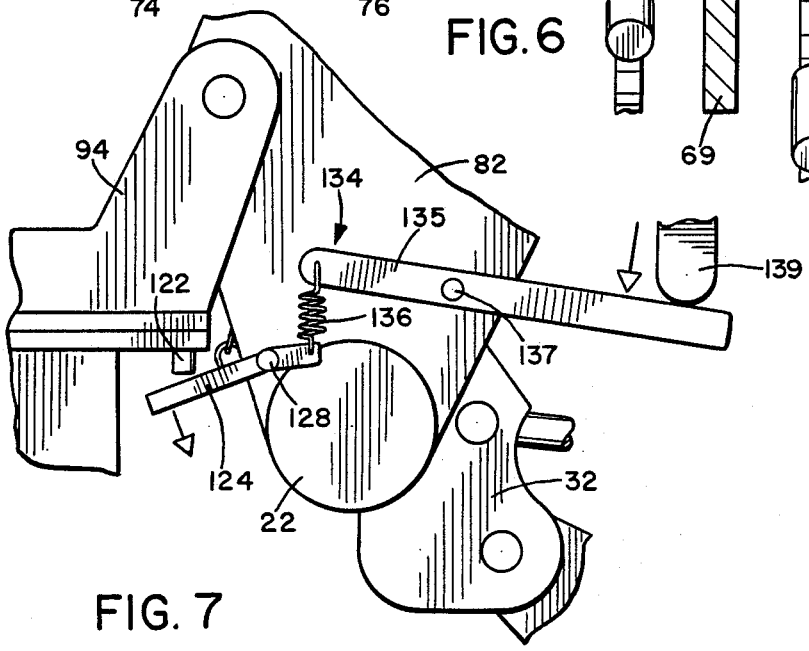
FIG. 7 is a side elevation view showing the wheel unit interlocking means in a released position.

A release lever mechanism 134 is secured at one end of the assembly, as shown in FIGS. 6 and 7, for rotating the mounting pin 128 in a direction to rotate the plates 124 downwardly out of engagement with the pin 122 of any lowered wheel unit when mounting bar 22 is raised. The lever mechanism comprises lever arm 135 secured to the end of the mounting pin 128 via spring 136 and pivotally connected to one of the support plates 82 at an intermediate point in its length via pin 137. Opposing springs 138 normally urge each retainer plate into the raised, operative position. The plates 124 and 132 are preferably all inclined downwardly slightly in the operative position, as shown in FIG. 4. When mounting bar 22 is raised, plate 82 will also be raised, so that the free end of lever arm 135 contacts the end 139 of the vehicle canopy, or some other fixed point on the canopy. This pushes lever arm 134 downwardly at one end, as indicated by the arrow in FIG. 7, and all the retainer plates are rotated downwardly about pin axis 128 and released from any lowered compaction units.

Figure 3:
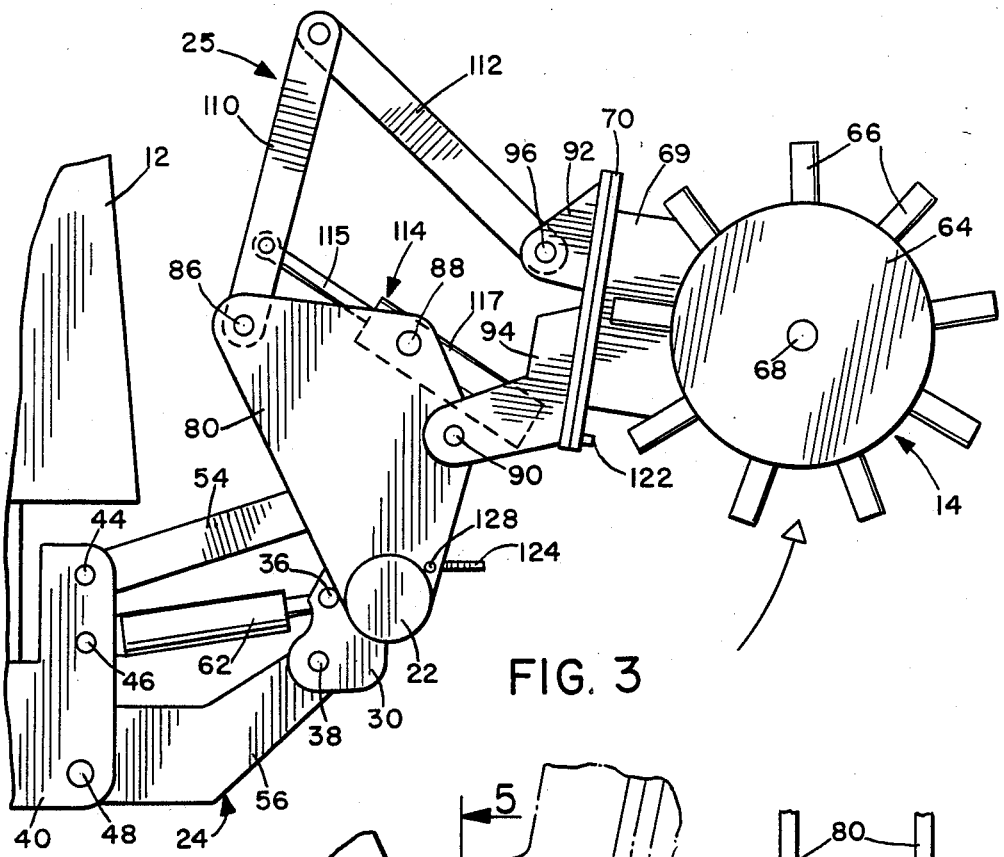
FIG. 3 is an enlarged side elevation view showing the raised portion of a wheel unit.
Figure 8:
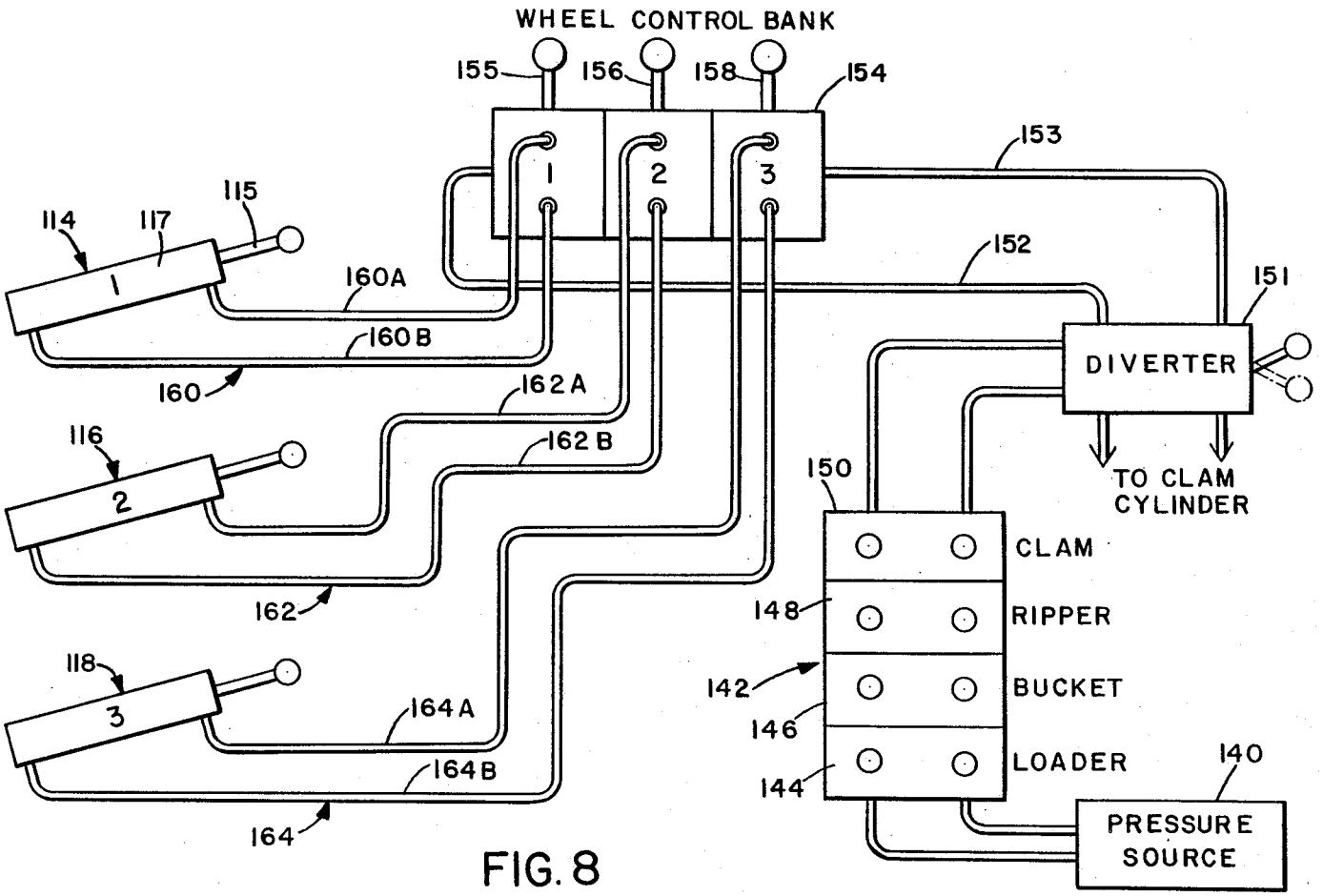
FIG. 8 is a block diagram of the hydraulic control system.

The compaction apparatus preferably utilizes the existing hydraulic actuating assembly in order to raise and lower the compaction units between the inoperative position shown in FIG. 3 and the operative, lowered position shown in FIG. 1, and in order to apply downward pressure on any lowered unit. FIG. 8 is a block diagram of the hydraulic control assembly for selectively operating the hydraulic actuators 58 for raising and lowering the mounting bar 22, and the hydraulic actuators 114, 116 and 118 for selectively raising and lowering the three compaction units.

The assembly includes a hydraulic pressure source 140 linked to a standard control panel 142 for an earth working vehicle such as a track loader, including switch units 144, 146, 148, and 150 for selectively applying hydraulic pressure to opposite ends of the cylinders of hydraulic actuators for operating a loader, bucket, ripper bar, and clam cylinder. The ripper bar in this case will be replaced by mounting bar 22, and thus switch unit 148 will control raising and lowering of mounting bar 22 as explained below. The existing hydraulic control assembly is modified by inserting a suitable pressure diverter 151, such as a valve unit, at the clam cylinder control outlet for selectively diverting hydraulic fluid along lines 152, 153 from the clam cylinder to a compaction control unit 154. The compaction control unit has three, two-position control levers 155, 156 and 158, one for each of the compaction units, for selectively supplying hydraulic fluid along three pairs of connecting lines 160, 162 and 164 to opposite ends of the respective hydraulic cylinders 117 in order to extend or retract the respective piston 115.

With this control assembly, the operator can elect to lower one, two or all of the compaction wheel units, varying the width of ground which can be compacted. For a relatively narrow, shallow ditches the central unit only may be lowered, whereas for wider ditches or trenches all three may be lowered.

As can be seen from FIGS. 1 and 3, a unit is raised when the respective hydraulic actuator has its piston 115 extended, and is lowered by retracting the piston 115 into the cylinder 117, drawing arm 110 downwardly towards point 88 and rotating the unit clockwise about point 90. The mounting rod 22 is shown in the inoperative, raised position in both FIGS. 1 and 3, with the pistons 60 retracted into cylinders 62. Once the selected unit or units have been lowered, operation of actuators 58 to extend pistons 60 will tend to rotate the rod 22 and mounting plates in a clockwise direction about points 38 to apply downward pressure on any lowered unit which is contacting the ground, or to lower the unit below the level of the vehicle in the case of a narrow trench.

In order to compact dirt in a narrow trench of width approximately equal to that of central compaction unit 16, the vehicle will be positioned with its tracks one on each side of the trench and the central unit 16 positioned above the trench. Lever 156 of the wheel control bank will then be operated so that hydraulic fluid is supplied to the cylinder 117 of actuator 116 along line 162A to retract its piston, lowering the central wheel unit only. The "ripper" control unit 148 will then be actuated, to extend pistons 60 to lower the unit 16 into the trench until it contacts the ground, and subsequently to apply downward pressure on the unit to compact the ground as the vehicle is driven along the trench. The compaction wheels rotate as the vehicle moves, compacting the layer of fill material in the trench. If all three wheel units are needed to compact dirt in a relatively wide trench, levers 155, 156 and 158 will be operated to supply hydraulic fluid along lines 160A, 162A and 164A to the actuators 114, 116 and 118, respectively to retract the respective pistons and lower the wheel units. Actuation of unit 148 then operates to apply downward pressure to the lowered units.

The mechanical interlock between pins 122 and 131, and retainer plates 124 and 132 of any lowered unit, ensures that excessive back loads will be taken by the vehicle and not transmitted to the hydraulic system. Any back load on the unit is applied around mounting point 90 (see FIG. 4), so that the pin rotates in an arc to bear against the sides of slot in the associated plate, and does not tend to lift out of the retainer plate. The slight downward tilt of the retainer plates also acts to ensure that the associated pins will bind in the slots as a result of upward forces.

When the compaction is completed, any interlocked retainer plate is automatically released by raising mounting bar 22, so that release arm 135 contacts the end of the vehicle canopy as indicated in FIG. 7. The wheel unit can then be raised by extending the corresponding piston of actuator 114, 116 or 118 by means of levers 155, 156, and 158, supplying fluid along respective lines 160B and 162B and/or 164B in a direction to extend the associated pistons.

The compaction wheel units are of standard widths corresponding to most construction ditch sizes. The three units allow areas ranging in width from around one foot to the width of the vehicle to be compacted. As explained above, other compaction devices may be used, such as vibratory plates or drum rollers.

Although hydraulic actuators are used in the preferred embodiment for raising and lowering the units, other actuators may be used in alternative embodiments.

The compacting apparatus of this invention allows the dirt in trenches of various widths to be compacted quickly and easily, and produces good compaction results. The apparatus can be designed for securing to any suitable earth working vehicle, and the existing hydraulic control system of the vehicle can be modified relatively easily to incorporate controls for each unit. Alternatively, a separate control system for independent raising and lowering of each unit may be provided. In the preferred embodiment, the units can be detached quickly and easily for repair, replacement, or cleaning purposes, or for replacement with other types of tools.

Although a preferred embodiment of the invention has been described above by way of example only, it will be understood by those skilled in the field that modifications may be made to the disclosed embodiment without departing from the scope of the invention, which is defined by the appended claims:

I claim:

1. An earth compacting apparatus for mounting on an earth working vehicle, comprising:

a plurality of separate compaction units each comprising means for applying downward pressure on fill dirt in the bottom of a trench;

linkage means connected to said compaction units for pivotally mounting the units side by side on a ground working vehicle , said linkage means including a mounting bar, mounting means for pivotally mounting the mounting bar across an end of the vehicle, and a series of compaction unit linkages pivotally secured at one end at spaced intervals along the mounting bar, each compaction unit linkage being pivotally secured at its opposite end to a respective one of the compaction units; and actuator means linked to said compaction units for independently raising and lowering said units between a raised position above the ground and a lowered position in contact with the ground, and for applying downward pressure on each unit contacting the ground.

2. The apparatus as claimed in claim 1, including releasable mounting means for releasably securing each unit to the linkage means.

3. The apparatus as claimed in claim 1, including a mechanical interlock between the mounting bar and each compaction unit in the lowered position for transmitting any back load to the vehicle.

4. The apparatus as claimed in claim 3, wherein the mechanical interlock comprises a series of retainer plates projecting forwardly from the mounting bar, each plate having a slot, and a series of pins projecting downwardly from each compaction unit for engagement in a respective one of the slots when that compaction unit is lowered so that any back pressure tending to rotate the compaction unit upwardly will rotate the pin to bear against the slot, the interlock further including a release mechanism for rotating each retainer plate out of engagement with its respective pin.

5. The apparatus as claimed in claim 4, wherein the mechanical interlock further comprises a common mounting pin rotatably mounted on the mounting bar and extending parallel to the mounting bar, each retainer plate being secured to the mounting pin, and biassing means between the retainer plates and mounting bar for urging the plates into a raised operative position in which they are tilted downwards slightly.

6. The apparatus as claimed in claim 1, wherein there are three compaction units pivotally connected at the center and the outer ends, respectively, of the mounting bar.

7. The apparatus as claimed in claim 1, wherein the mounting means for mounting the mounting bar at the end of the vehicle comprises means for securing the mounting bar to existing mounting points on a track loader for normally mounting a ripper bar at the rear end of the loader.

8. The apparatus as claimed in claim 7, wherein the mounting means comprises two spaced pairs of yoke plates secured to the mounting bar and each having three spaced mounting points for pivotally securing to upper and lower spaced linkage arms and to an hydraulic actuator, respectively, of a ripper bar mounting assembly.

9. An earth compacting apparatus for mounting on an earth working vehicle, comprising a plurality of separate compaction units each comprising means for compacting fill dirt;

a mounting assembly for pivotally mounting the units side by side on a ground working vehicle, comprising a mounting bar, linkage means pivotally secured at one end at spaced intervals along the mounting bar, each linkage means being pivotally secured at its opposite end to a respective one of the compaction units, and mounting means secured to said mounting bar for pivotally mounting the mounting bar across an end of the vehicle; and actuator means for independently raising and lowering said units between a raised position above the ground and a lowered position in contact with the ground, and for applying downward pressure on each unit contacting the ground, the actuator means including a first hydraulic actuator assembly linked to each compaction unit for selectively raising and lowering each compaction unit independently, and a second hydraulic actuator assembly linked to said mounting bar for acting on the mounting bar to apply down pressure on any compaction unit in contact with the ground.

10. The apparatus as claimed in claim 9, wherein each compaction unit linkage includes a support plate secured transversely to the mounting bar, and a pair of pivotally connected linkage arms pivotally secured between a first point on the support plate and the respective compaction unit, the first hydraulic actuator assembly comprising a series of hydraulic piston and cylinder actuators, one each associated with each of the compaction units, each actuator being secured between a second point on the support plate and the linkage arms of the respective compaction unit.

11. The apparatus as claimed in claim 9, wherein the first actuator assembly includes a series of hydraulic piston and cylinder actuators, one each being associated with each of the compaction units, the apparatus further including a control assembly for selectively applying hydraulic pressure to the actuator assemblies, the control assembly including a first manually operable control unit having a control for each of the compaction unit actuators for selectively raising or lowering the respective compaction units independently, and a second manually operable control unit for selectively operating the second actuator assembly for selectively acting on the mounting rod to raise or lower the rod or apply downward pressure on any lowered compaction unit.

12. A method of compacting fill dirt in trenches using a vehicle on which a multiple compaction unit assembly is mounted, comprising the steps of:

lowering a selected number of compaction units into an operative position in contact with the material in the trench, the selected number of units corresponding in width to the width of the trench to be compacted; and compacting the fill material in the trench by applying down pressure on the lowered units while driving the vehicle over the fill material.

13. An earth working apparatus for mounting on an earth working vehicle, comprising:

at least three separate earth working tool units;

a mounting assembly for pivotally mounting the units side by side on a ground working vehicle, the mounting assembly including a mounting bar and linkage means for pivotally mounting each unit on the mounting bar; and actuator means for independently raising and lowering said units between a raised position above the ground and a lowered position in contact with the ground, and for applying downward pressure on each unit contacting the ground;

the actuator means including a first hydraulic actuator acting between each tool unit and the mounting bar for selectively raising and lowering each tool unit independently relative to the mounting bar, and a second hydraulic actuator assembly acting on the mounting bar to apply down pressure on any tool unit in contact with the ground.

* * * * *